US006888039B2

(12) United States Patent
Pidgeon

(10) Patent No.: US 6,888,039 B2
(45) Date of Patent: May 3, 2005

(54) PURIFICATION PROCESS

(75) Inventor: Ian Charles Pidgeon, St. Albans (GB)

(73) Assignee: BP Oil International Limited, London (GB)

( * ) Notice: Subject to any disclaimer, the term of this patent is extended or adjusted under 35 U.S.C. 154(b) by 674 days.

(21) Appl. No.: 09/977,246

(22) Filed: Oct. 16, 2001

(65) Prior Publication Data

US 2002/0060170 A1 May 23, 2002

Related U.S. Application Data

(63) Continuation of application No. PCT/GB00/01384, filed on Apr. 12, 2000.

(30) Foreign Application Priority Data

Apr. 16, 1999 (GB) ..... 9908752

(51) Int. Cl.[7] ..... C07C 7/12; C10G 25/05

(52) U.S. Cl. ..... 585/826; 585/820; 585/825; 585/826; 585/830; 208/208 R; 208/213; 208/254 R; 208/252.1; 208/299

(58) Field of Search ..... 208/213, 254 R, 208/262.1, 299, 208 R; 585/820, 822, 825, 826, 830

(56) References Cited

U.S. PATENT DOCUMENTS

| | | | | |
|---|---|---|---|---|
| 3,188,293 | A | 6/1965 | Bacon et al. | 502/34 |
| 3,405,507 | A | 10/1968 | Spencer et al. | |
| 3,479,797 | A | 11/1969 | Miller, Jr. | |
| 3,620,969 | A | 11/1971 | Turnock et al. | |
| 3,712,027 | A | 1/1973 | Hasz | |
| 3,733,775 | A | 5/1973 | Barrere, Jr. | |
| 3,760,029 | A | 9/1973 | McCoy | |
| 3,767,563 | A | 10/1973 | Woodle | |
| 3,816,975 | A | 6/1974 | Collins | |
| 3,954,983 | A | 5/1976 | Albrecht et al. | |
| 4,098,684 | A | 7/1978 | Innes | |
| 4,179,361 | A | 12/1979 | Michlmayr | 208/244 |
| 4,188,285 | A | 2/1980 | Michlmayr | |
| 4,318,802 | A | 3/1982 | Van Grinsven et al. | 208/245 |
| 4,336,130 | A | 6/1982 | Miller et al. | |
| 4,383,916 | A | 5/1983 | Gutberlet et al. | |
| 4,398,927 | A | 8/1983 | Asher et al. | |

(Continued)

FOREIGN PATENT DOCUMENTS

FR 1 284 210 A 7/1962

OTHER PUBLICATIONS

Irvine et al., "Converting carbon residue to power and hydrogen needs", Hydrocarbon Technology 47–50 (1994).

*Primary Examiner*—Walter D. Griffin
*Assistant Examiner*—Tam Nguyen
(74) *Attorney, Agent, or Firm*—Nixon & Vanderhye

(57) ABSTRACT

A process of reducing the sulfur content of gasoline product comprising at least three concurrent steps: a) passing input fluid comprising pollutant through at least one adsorber to produce a polluted adsorber and a purified fluid stream which leaves the adsorber, stopping the flow into said adsorber to leave residual fluid therein, and separating said residual fluid therein said adsorber to leave the polluted adsorber of reduced residual fluid content, b) heating a polluted adsorber with a heated regeneration gas to produce a hot adsorber and cooler regeneration gas, c) contacting a heated adsorber with a regeneration gas (of a lower temperature than that of said adsorber) to produce a cooler adsorber and a warmer regeneration gas, which gas is further heated to produce said heated regeneration gas which is pass to step b), said process comprising at least 3 adsorber, at least one of which being subjected to step a) at least one different adsorber to step b) and at least one further different adsorber being subjected to step c) and after completion of one step the adsorber produced is subjected to the next step in the cyclic sequence a)-b)-c)-a).

11 Claims, 4 Drawing Sheets

Figure 1:
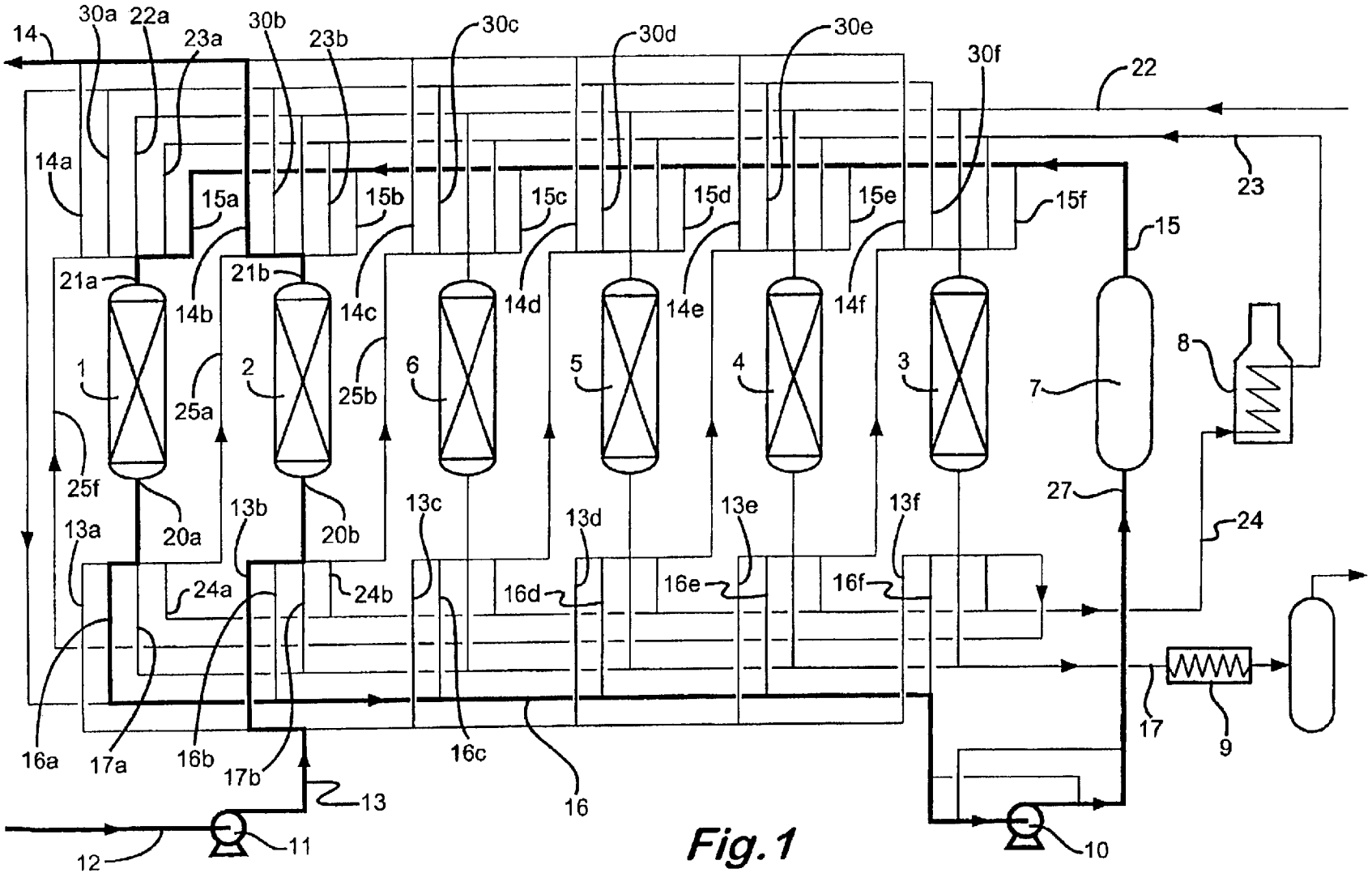

U.S. PATENT DOCUMENTS 4,404,118 A 9/1983 Herskovits
4,419,224 A 12/1983 Miller et al.
4,522,793 A 6/1985 Larson et al.
4,774,067 A 9/1988 Voirin et al.
4,775,462 A 10/1988 Imai et al.
4,775,484 A 10/1988 Schmidt et al.
4,830,733 A 5/1989 Nagji et al.
4,830,734 A 5/1989 Nagji et al.
4,831,206 A 5/1989 Zarchy
4,831,207 A 5/1989 O'Keefe et al.
4,835,338 A 5/1989 Liu ..... 585/823
5,012,037 A 4/1991 Doshi et al.
5,094,755 A 3/1992 Knaebel
5,114,689 A 5/1992 Nagji et al.
5,157,201 A 10/1992 Norris
5,447,701 A 9/1995 Inoue et al.
5,730,860 A 3/1998 Irvine
5,843,300 A 12/1998 Zinnen et al.
5,891,323 A 4/1999 Willis
5,914,292 A 6/1999 Khare et al.
5,935,422 A 8/1999 Zinnen

PURIFICATION PROCESS

This application is a continuation of PCT/GB00/01384, filed Apr. 12, 2000.

The present invention relates to an improved fixed bed process capable of reducing the sulphur content of the gasoline product resulting from the cracking of a high molecular weight hydrocarbon feed comprising sulphur.

Sulphur in the product results primarily from sulphur in the high molecular weight feed which can be present in a number of different species. These species include thiols and sulphides e.g. alkyl, alkenyl and aryl ones and aromatic sulphur heterocyclic compounds e.g. benzothiophenes. Environmentally driven legislation requires much lower levels of sulphur in gasoline.

A number of techniques have been considered, including that of adsorption, to remove sulphur from gasoline. These processes may be energy inefficient.

We have now found an improved fixed bed process of improved energy efficiency capable of reducing the sulphur content of the gasoline product resulting from the cracking of a high molecular weight hydrocarbon feed comprising sulphur.

Accordingly the present invention provides a cyclic process to remove pollutant from fluid which comprises at least three concurrent steps:

(a) passing input fluid comprising pollutant through at least one adsorber to produce a polluted adsorber and a purified fluid stream of reduced pollutant content, which leaves the adsorber, stopping the flow into said adsorber to leave residual fluid therein, and separating said residual fluid from said adsorber to leave the polluted adsorber of reduced residual fluid content, (b) heating a polluted adsorber, optionally containing residual fluid, with a heated regeneration gas to produce a hot adsorber (of reduced pollutant content) and cooler regeneration gas (of increased pollutant content), (c) contacting a heated adsorber (of reduced pollutant content) with a regeneration gas (of a lower temperature than that of said adsorber) to produce a cooler adsorber and a warmer regeneration gas, wherein at least some and preferably all of the warmer regeneration gas is further heated to produce said heated regeneration gas which is passed to step (b)

said process comprising at least 3 adsorbers, at least one of which is being subjected to step (a), at least one different adsorber to step (b) and at least one further different adsorber being subjected to step (c), and after completion of one step the adsorber produced is subjected to the next step in the cyclic sequence (a)-(b)-(c)-(a).

A single gas passing through a single line maybe used to both cool and heat the adsorbers such that the process maybe carried out without the use of a separate cooling gas passing through a separate cooling line and a separate heating gas passing through a separate heating line wherein heat is exchanged (via a heat exchanger) from said gas in the cooling line which has acquired heat whilst cooling the adsorbers to said gas in the heating line prior to heating the adsorbers.

If the volume of residual fluid in the adsorber in step (a) is small compared to the total input fluid flow, this residual fluid may be separated from the adsorber in step (a) and passed into the input fluid without unduly upsetting the latter's flow rate. Usually the residual fluid volume is relatively large and is passed from step (a) into a hold up or retention container. This residual fluid can be returned to refill the adsorber with polluted fluid at the start of step (a) after the adsorber has been regenerated in steps (b) and (c) without causing a reduction in the flow of purified fluid from step (a).

The fluid may be a gas but is preferably a liquid. When the fluid is a liquid, the liquid is preferably drained from the adsorber in step (a) under gravitational force or alternatively pumped into the hold up or retention container e.g. a drain tank.

In step (a) one adsorber may be being treated, but usually at least 2 adsorbers e.g. 2–6 are being subjected to step (a) at any one time especially 1 or 2; adsorption may be in series or parallel. Typically increasing the number of adsorbers in series being subjected to step (a) increases the extent of purification.

Advantageously step (b) may comprise a number of adsorbers e.g. 2–6 undergoing a number of heating stages e.g. 2–6 wherein the hot regeneration gas passes in series through increasingly polluted adsorbers of increasing temperature wherein the hottest regeneration gas (i.e. regeneration gas at its highest temperature) contacts the least polluted adsorber first. Thus step (b) can comprise multi step heat exchange and pollutant exchange between hot regeneration gas and polluted adsorber to give polluted cooler gas and less polluted hotter adsorber. Preferably step (b) may comprise two stages namely (b)(i) heating a polluted adsorber with regeneration gas (of increased pollutant content) to produce a heated polluted adsorber then (b)(ii) further heating a heated polluted adsorber with heated regeneration gas to produce a hot adsorber (of reduced pollutant content) and said regeneration gas (of increased pollutant content) which is passed to (b)(i). Thus in this case step (b) has two adsorbers wherein regeneration gas from step (c) is passed through in series to heat them and desorb the pollutant. Alternatively step (b) may comprise at least 2 adsorbers e.g. 2–6 operating in parallel trains, each train having 1 stage (b) or several stages (b)(i), b(ii), b(iii) etc operating in series.

Advantageously step (c) may also comprise a number of adsorbers e.g. 2–6 undergoing a number of cooling stages e.g. 2–6 wherein the regeneration gas passes in series through adsorbers of increasing temperature and wherein the coolest regeneration gas (i.e. regeneration gas at its lowest temperature) contacts the coolest adsorber first. Thus step (c) can comprise multistep heat exchange between hot adsorber and cooler unpolluted gas. Preferably step (c) comprises two stages namely (c)(i) cooling a hot adsorber (of reduced pollutant content) from step (b) with regeneration gas (of a lower temperature than that of the hot adsorber) to produce a cooled adsorber, and heated regeneration gas, then (c)(ii) further cooling a cooled adsorber with a regeneration gas (of a lower temperature than that of the cooled adsorber) and regeneration gas which is passed to step c(i).

The heated regeneration gas produced in step c(i) is then heated further and passed to step (b).

The steps (b)(i) and (b)(ii) can be used in combination with (c) or (c)(i) and (c)(ii), and (c)(i) and (c)(ii) can be used in association with step (b).

With two adsorbers in step (b) and two adsorbers in step (c) at any one time, 4 adsorbers will be undergoing regeneration steps at that time. During regeneration the first two adsorbers are heated in step (b) whilst the last two are cooled in step (c). Heat is recovered by passing the regeneration gas in series through each of the regenerating adsorbers. Each adsorber passes through the regeneration steps in the order (b)(i), (b)(ii), (c)(i) then (c)(ii). In steps (b)(i) and (b)(ii), they are heated by hot gas and then in steps (c)(i) and (c)(ii) they are cooled by cold gas. The gas picks up heat in steps (c)(i) and (c)(ii) (and finally by passing through a heater before passing to step (b)), where the hot gas is then cooled in steps (b)(ii) and (b)(i), and may optionally be cooled further by passing the gas through a cooler. As a result the heater supplies less thermal energy to the regeneration gas and optionally the cooler removes less thermal energy from the regeneration gas than in a 2-adsorber process. The greater the number of adsorbers, the smaller the energy input of the heater and optionally the energy removal of the cooler.

Regeneration time (i.e. steps (b) and (c) in total) can be 2–24hr e.g. 6–16hr while adsorption time (i.e. steps (a) in total) may be 0.5–10hr e.g. 1–3hr. The process is cyclic so regeneration occurs in some adsorbers while adsorption occurs in the regenerated ones; preferably the ratio of adsorption to regeneration time in total is in the range 1:2–1:10, most preferably 1:2–1:8 especially 1:2 –1:6 e.g. 1:5. Preferably the ratio of the times is about the same as the ratio of number of adsorbers in adsorbing mode to regeneration mode. A larger total number of adsorbers can reduce the amount of adsorbent in each, so each adsorber may be smaller. Usually the fixed-bed adsorption process of the invention will comprise an even number of adsorbers especially 4–12, such as 4, 6, 8, or 10 adsorbers. Preferably 2 adsorbers are in step (a), 1–4 are in step (b) and 1–4 are in step (c), in particular with the same number in each of (b) and (c).

In a preferred embodiment of the invention the process comprises 4 adsorbers wherein in step (a) the fluid stream containing a pollutant is passed through a first adsorber wherein the pollutant is adsorbed from the fluid stream. This is continued until said first adsorber requires regeneration which is usually when it is at least 50% preferably at least 70% and most preferably at least 90% saturated with pollutant; these degrees of saturation apply generally to step (a), whatever the number of adsorbers. The fluid stream flow through said adsorber is stopped and diverted to another regenerated second adsorber ready to undergo the adsorption part of step (a). The residual fluid is then separated from said first adsorber in the separation part of step (a) and preferably passed into a drain tank. Regeneration gas e.g. from the drain tank may replace the fluid in the first adsorber.

Thus the first adsorber may be adsorbing while the second one is filling with input fluid following its regeneration and cooling in steps (b) and (c), and then at a later time the first one maybe being drained while the second one is adsorbing. If desired between these 2 times, both absorbers may be adsorbing contemporaneously.

In step (b) of the 4 adsorber process regeneration gas flows from step (c) through a third adsorber wherein the remaining fluid is separated from said third adsorber and the pollutant desorbed from said third adsorber. At the beginning of (b) the regeneration gas enters the third adsorber at a temperature of preferably between 250–350° C. most preferably between 260–300° C. e.g. 280° C. At the end of (b) the gas enters the fourth adsorber at a temperature of preferably between 120–260° C. most preferably between 160–200° C. e.g. 180° C. The inlet and the outlet of said third adsorber at the start of step (b) are preferably between 10–50° C. e.g. 20–30° C. After step (b) has been completed said third adsorber inlet has a temperature of preferably between 150–300° C. most preferably between 250–290° C. e.g. 280° C. and the temperature at the outlet of preferably between 100–250° C. most preferably between 180–220° C. e.g. 200° C. At the start of (b) the outlet gas has a temperature of preferably between 10–50° C. e.g. 20–30° C. At the end of (b) the outlet gas has a temperature of preferably between 100–250° C. most preferably between 180–220° C. e.g. 200° C.

In step (c) a fourth adsorber is cooled by passing through regeneration gas. Cooled regeneration gas enters the inlet of the fourth adsorber throughout (c) at a temperature of preferably between 0–50° C. e.g. 20–40° C. The inlet temperature of said fourth adsorber at the start of step (c) is preferably between 150–300° C. most preferably between 250–290° C. e.g. 280° C. and the outlet temperature is preferably between 100–250° C. most preferably between 180–220° C. e.g. 200° C. After step (c) has been completed said fourth adsorber inlet and outlet has a temperature of preferably between 10–50° C. e.g. 20–40° C. most preferably between 25–35° C. e.g. 30° C. At the start of (c) the outlet gas has a temperature of preferably between 250–300° C. most preferably between 260–280° C. e.g. 270° C. At the end of (c) the outlet gas has a temperature of preferably between 10–50° C. e.g. 20–40° C. most preferably between 25–35° C. e.g. 30° C.

In the most preferred embodiment of the present invention the process comprises 6 adsorbers wherein a first and second adsorber are being subjected to step (a) is as herein described above, step (b) comprises two stages wherein a third adsorber is being subjected to (b)(i) and a fourth adsorber is being subjected to (b)(ii). Step (c) also comprises two stages with a fifth adsorber on stage (c)(i) and a sixth on stage (c)(ii).

In step (b)(i) regeneration gas flows through a third adsorber. The regeneration gas derives from step (b)(ii). At the beginning of (b)(i) the regeneration gas enters the third adsorber at a temperature of preferably between 100–200° C. most preferably between 120–140° C. e.g. 130° C. At the end of (b)(i) the gas enters the third adsorber at a temperature of preferably between 250–300° C. most preferably between 260–280° C. e.g. 270° C. The inlet and the outlet of said third adsorber at the start of step (b)(i) are preferably between 10–50° C. e.g. 20–30° C. After step (b)(i) has been completed said third adsorber inlet has a temperature of preferably between 250–300° C. most preferably between 260–280° C. e.g. 270° C. and a temperature at the outlet of preferably between 100–200° C. most preferably between 110–150° C. e.g. 130° C. At the start of (b)(i) the outlet gas has a temperature of preferably between 0–50° C. e.g. 20–40° C. At the end of (b)(i) the outlet gas has a temperature of preferably between 100–200° C. most preferably between 120–140° C. e.g. 130° C.

In step (b)(ii) regeneration gas flows through a fourth adsorber and further desorbs the pollutant from said adsorber. The regeneration gas derives from step (c)(ii) and has been passed through a heater. At the beginning of (b)(ii) the regeneration gas enters the fourth adsorber at a temperature of preferably between 250–350° C. most preferably between 260–300° C. e.g. 280° C. At the end of (b)(ii) the gas enters the fourth adsorber at a temperature of preferably between 100–250° C. most preferably between 180–220° C. e.g. 200° C. The inlet of said fourth adsorber at the start of step (b)(ii) is preferably between 250–300° C. most preferably between 260–280° C. e.g. 270° C. and the outlet of said fourth adsorber at the start of step (b)(ii) is preferably between 100–200° C. most preferably between 120–140° e.g. 130° C. After step (b)(ii) has been completed said fourth adsorber inlet has a temperature of preferably between 170–300° C. most preferably between 180–220° C. e.g. 200° C. and the temperature at the outlet of preferably between 200–300° C. most preferably between 260–280° C. e.g. 270° C. The regeneration gas exits the adsorber throughout stage (b)(ii). At the start of (b)(ii) the outlet gas has a temperature of preferably between 100–200° C. most preferably between 120–140° C. e.g. 130° C. At the end of (b)(ii) the outlet gas has a temperature of preferably between 250–300° C. most preferably between 260–280° C. e.g. 270° C.

In step (c)(i) regeneration gas is passed through a fifth adsorber. The regeneration gas derives from step (c)(ii) and at the beginning of (c)(i) enters the fifth adsorber at a temperature of preferably between 50–150° C. most preferably between 80–120° C. e.g. 95° C. At the end of (c)(i) the gas enters the fifth adsorber at a temperature of preferably between 0–50° C. e.g. 20–40° C. The inlet of said fifth adsorber at the start of step (c)(i) is preferably between 300–170° C. most preferably between 180–220° C. e.g. 200° C. and the outlet of said fifth adsorber at the start of step (c)(i) is preferably between 200–300° C. most preferably between 260–280° C. e.g. 270° C. After step (c)(i) has been completed said fifth adsorber inlet has a temperature of preferably between 20–50° C. most preferably between 25–45° C. e.g. 35° C. and a temperature at the outlet of preferably between 50–150° C. most preferably between 80–120° C. e.g. 100° C. The regeneration gas exits the adsorber throughout stage (c)(i). At the start of (c)(i) the outlet gas has a temperature of preferably between 250–300° C. most preferably between 260–280° C. e.g. 270° C. At the end of (c)(i) the outlet gas has a temperature of preferably between 50–150° C. most preferably between 80–120° C. e.g. 95° C.

In step (c)(ii) regeneration gas flows through a sixth adsorber. Cooled regeneration gas enters the inlet of the sixth adsorber throughout (c)(ii) at a temperature of preferably between 0–50° C. e.g. 20–40° C. The inlet of said sixth adsorber at the start of step (c)(ii) is preferably between 10–50° C. most preferably between 30–40° C. e.g. 35° C. and the outlet of said sixth adsorber at the start of step (c)(ii) is preferably between 50–150° C. most preferably between 80–120° C. e.g. 95° C. After step (c)(ii) has been completed said sixth adsorber inlet has a temperature of preferably between 10–50° C. e.g. 20–40° C. most preferably between 25–35° C. e.g. 30° C. and the temperature at the outlet of preferably between 20–50° C. most preferably between 25–45° C. e.g. 35° C. The regeneration gas exits the adsorber throughout stage (c)(ii). At the start of (c)(ii) the outlet gas has a temperature of preferably between 50–150° C. most preferably between 80–120° C. e.g. 95° C. At the end of (c)(ii) the outlet gas has a temperature of preferably between 0–50° C. e.g. 20–40° C.

The process of the invention, and thus the adsorbers, and the preferred drain tanks usually operate at pressures of up to 60 barg preferably up to 40 barg and most preferably up to 30 barg, e.g. 1–60, 5–40 or 15–25 or 20 barg.

The fluid stream comprising a pollutant may be a gas or a liquid, but is preferably a liquid hydrocarbon stream, in particular a gasoline product resulting from the cracking of a high molecular weight hydrocarbon feed comprising a pollutant heteroatomic organic molecule e.g. one with nitrogen but preferably sulphur and especially wherein the pollutant content comprises 0.01–5% sulphur or N compounds (expressed as elemental S) e.g. 200–3000 ppm S. Typically the process can provide a purified stream comprising 150–0 ppm S usually 50–5 ppm S e.g. 10 ppm S.

The adsorbers contain adsorbent that can carry out adsorption of the pollutant and can be regenerated for repeated use. The adsorption may be physisorption or chemisorption or both. In particular the adsorbent provides selective adsorption of heteroatom e.g. sulphur containing molecules over the hydrocarbons in the feed.

Suitable adsorbents may be provided by porous oxides e.g. metal or non metal oxides. The metal oxides are advantageously from di, tri and tetravalent metals, which may be transition or non transition metals or rare earth metals, such as alumina, titania, cobaltic oxide, zirconia, ceria, molybdenum oxide, magnesia and tungsten oxide. An example of a non metal oxide is silica. More than one type of adsorbent may be present. Advantageously the adsorbent is selected from silica-alumina, zirconia, silica-zirconia, titania and magnesia or any combinations thereof. In particular the adsorbent is activated alumina or silica gel.

The adsorbent may comprise incorporated elemental metal usually selected from the metal Groups VIIIA, IB, IIB, IIIB, IVB and VB in particular group VIIIA e.g. nickel, cobalt and especially the platinum metals e.g. platinum, palladium, ruthenium, rhodium, osmium, and iridium. The groups are as described in the Periodic Table in Basic Inorganic Chemistry by F. A. Cotton, G. Wilkinson and P. L Gaus Publ. John Wiley & Sons, Inc. New York 2nd Ed. 1986. Advantageously the adsorbent comprises nickel with one or more platinum group metals e.g. platinum.

Alternatively the adsorbent may comprise a zeolite. These zeolites may be synthetic e.g. zeolites A, X, Y and L or naturally occurring zeolites e.g. faujasite. In particular zeolite of type X is preferred especially 13X. Most preferably the zeolite has been exchanged with alkali or alkaline earth cations in particular potassium. The zeolite may also comprise a group VIII metal as elemental metal to aid regeneration, in particular palladium or platinum.

In another embodiment of the invention the adsorbent may be carbon based e.g. activated carbon.

The weight of adsorbent within the adsorber is determined by the amount of pollutant to which the adsorbent will be exposed during the adsorption period.

The process is usually controlled by the remotely operated valves (ROVs). All ROVs are preferably suitable for use at the above temperatures and pressures.

The regeneration gas may be any gas or gas mixture that does not deactivate the adsorbent. The regeneration gas or gas mixture may comprise hydrogen, nitrogen, oxygen, helium, argon, carbon monoxide, carbon dioxide, water vapour or C1–C5 hydrocarbons. Preferably the gas or mixture comprises hydrogen, nitrogen, helium, argon, carbon monoxide, or C1–C5 hydrocarbons such as methane, or a mixture thereof especially hydrogen. In particular the regeneration gas is the 'off gas' from a catalytic reformer and comprises a molar percentage of 50–95% hydrogen and 50–5% C1–C5 hydrocarbons. The process is usually performed under non oxidising and especially reducing conditions.

In another aspect the invention provides apparatus for transferring impurities from a fluid feed containing them to a regeneration gas via an adsorbent to leave a purified fluid and gas comprising impurities, which comprises at least 3 adsorbers, each for containing means for adsorbing said impurities, each adsorber comprising at least one first port and at least one second port, said apparatus also comprising at least one first inlet line for said fluid feed, at least one second exit line for said purified fluid, at least one third input line for regenerating gas and at least one fourth exit line for gas comprising impurities, said first port(s) of each adsorber being capable of being in fluid communication with said first inlet line(s), said second port(s) of each adsorber being capable of being in fluid communication with said second exit line(s), said first port(s) of each adsorber being capable of being in fluid communication with a second port of at least one other adsorber in series, said communication being via heating means between at least one pair of adsorbers, said first port(s) of each adsorber being capable of being in fluid communication with said fourth exit line(s), and said second port(s) of each adsorber being capable of being in fluid communication with said third input line(s).

Preferably at least one first port of at least two and preferably each absorber is joined to said first input line in parallel, and preferably each second port of at least 2 and preferably each adsorber is joined to said second exit line in parallel. In particular said first and second lines are spaced by said adsorbers by transfer lines in parallel.

Preferably at least one second part of at least two and preferably each adsorber is joined to said third input line in parallel, and preferably each first part of at least 2 and preferably each adsorber is joined to said fourth exit line in parallel. In particular said third and fourth lines are spaced by said adsorbers by transfer lines in parallel.

Preferably at least one first or second port of at least 2 and preferably each adsorber is connected in series and in parallel. Advantageously a first part of one adsorber is connected to a second port of another adsorber.

The said heating means is preferably connected to said first parts in parallel, and/or and to said second ports in parallel.

Preferably the apparatus comprising at least one pumping means e.g. a pump for liquids which is connected to at least one pair of adsorbers. Advantageously the pump is connected in parallel to each first part and/or in parallel to each second port.

Advantageously the apparatus comprises at least one means for containing fluid, e.g. contaminated fluid and/or gas, which means is joined to at each one first port and at least one second port of at least one adsorber. Preferably the containing means is connected to a first port of each adsorber in parallel, and to a second port of each adsorber in parallel. The containing means is usually a drain tank or column.

Preferably at least one adsorber and especially each adsorber has one first port and one second port of each adsorber in parallel. The containing means is usually a drain tank or column.

Preferably at least one adsorber and especially each adsorber has one first port and one second port, but with 2–10 connecting lines to each port, in particular the same number of connecting lines as adsorber to each second port, and one less than that number of lines to each first port.

The apparatus is fitted with valves in the connecting lines in particular located in lines directly leading to first or second ports. The valves enable the polluted fluid to be passed to each adsorber. The operation of the valves may be in turn and so each adsorber can be regenerated in turn. The operation of the valves may be under manual control, but is preferably automated e.g. under computer control.

A further embodiment of the invention provides apparatus comprising at least three adsorbers and a heater wherein said three adsorbers are connected in parallel via parallel connecting pipework through which fluid comprising a pollutant can pass and wherein said three adsorbers and said heater are connected in series via series connecting pipework through which regeneration gas can pass and wherein said heater is located between at least two said adsorbers through said series connecting pipework.

Preferably the apparatus will comprise at least four adsorbers most preferably six. Advantageously two pairs of adsorbers are connected in series via said heater. Usually the apparatus will comprise at least one drain tank in communication via pipework with each adsorber present. Optionally the apparatus will also comprise a cooler through which regeneration gas can pass after exiting the adsorbers connected in series.

The process of the invention with at least 3 adsorbers can give significant energy savings, as a result of reduced power use in the heater.

The invention will now be described and illustrated with reference to the accompanying drawings in which FIG. 1-4 are flow diagrams for a six adsorber process showing successive process operations namely step (a) and steps (b)(c) respectively but without valves which are omitted for reasons of clarity. The apparatus shown has six adsorbers (1)–(6) e.g. of metal each preferably with a diameter of 3 m and a height of 8 m. Each adsorber contains a fixed bed of adsorbent e.g. activated alumina. The total amount of adsorbent used in the process with the preferred diameter absorbers is 276 tonnes. The adsorbers are connected in parallel to a supply of liquid hydrocarbon feed comprising sulphur by the necessary valves and pipework e.g. of metal. The liquid hydrocarbon feed comprising sulphur is supplied to the adsorbers from feed line (12) via a feed pump (11). The adsorbers are also connected in parallel to a drain tank (7) (e.g. metal and preferably also with a diameter of 3 m and a height of 8 m) via a transfer pump(10). In addition the adsorbers are connected in series by the necessary valves and pipework to a supply line (22) for regeneration gas and a heater (8), with which each absorber forms a loop and a cooler (9).

FIG. 1-4 show six adsorbers 1, 2, 6, 5, 4, 3 respectively, a drain tank 7, heater 8, cooler 9, pump 10 and pump 11. Each adsorber has a first port 20*a–f* respectively and second port 21*a–f* respectively, each of which may be inlets or outlets. Fluid feed line 12 leads to pump 11 and thence by input line 13 towards adsorbers 1–6 via lines 13*a–f* respectively. Purified fluid line 14 takes purified fluid from adsorbers 1–6 via output lines 14*a–f* respectively. Fluid can be passed through two adsorbers in series via lines 30*a–f*.

Recycle line 15 leads from drain tank 7 via lines 15*a–f* respectively from ports of 21*a–f* of adsorbers 1–6. Second recycle line 16 leads from ports 20*a–f* of adsorbers 1–6 via lines 16*a–f* respectively to pump 10, line 27 and drain tank 7. Drain tank 7 is also joined to pump 10 via line 28 and thence to line 16 via line 29. Input regeneration gas line 22 leads via input lines 22*a–f* to adsorbers 1–6 and exit regeneration gas line 17 leads via 17*a–f* respectively from adsorbers 1–6 to cooler 9. Regeneration gas line 23 leads via lines 23*a–f* respectively to adsorbers 1–6, while return gas line 24 links via lines 24*a–f* respectively heater 9 with adsorbers 1–6. Lines 25*a–f* link first ports 20*a–f* respectively of adsorbers 1–6 to second ports 21*a–f* of adsorbers 1–6. From first port 20*a* of adsorber 1 extend five lines 13*a*, 16*a*, 17*a*, 24*a*, and 25*a*. From second port 21*a* of adsorber 1 extend six lines 25*f*, 14*a*, 30*a*, 22*a*, 23*a* and 15*a*. Corresponding ports 20*b–f* and 21*b–f* have correspondingly numbered lines. Adsorbers 1–6 are linked to one another via ports 21*a–f* of one adsorber, lines 30*a–f*, 30, 16 and 16*b–a* and ports 20*b–a* of another adsorber.

FIG. 1 shows the step (a) process of adsorption and separation drain for a 6-bed process in which adsorber (2) is adsorbing and adsorber (1) is draining. Liquid hydrocarbon feed comprising sulphur enters the feed pump (11) via line (12). The liquid hydrocarbon feed passes via line (13) and (13*b*) into the inlet (20*b*) of the second adsorber (2) wherein sulphur is adsorbed from the liquid hydrocarbon feed and purified liquid hydrocarbon feed (of reduced sulphur content) exits the outlet (21*b*) of the second adsorber via line (14*b*) which leads to main purified product line (14) from which it is recovered. Regeneration gas from drain tank (7) via lines (15) and (15*a*) enters the inlet (21*a*) of the first adsorber (1) while residual liquid hydrocarbon feed drains from outlet (20*a*) of said first adsorber (1) via lines (16*a*) and (16) wherein it passes into a transfer pump (10) and then via line (27) into a drain tank (7).

Figure 2:
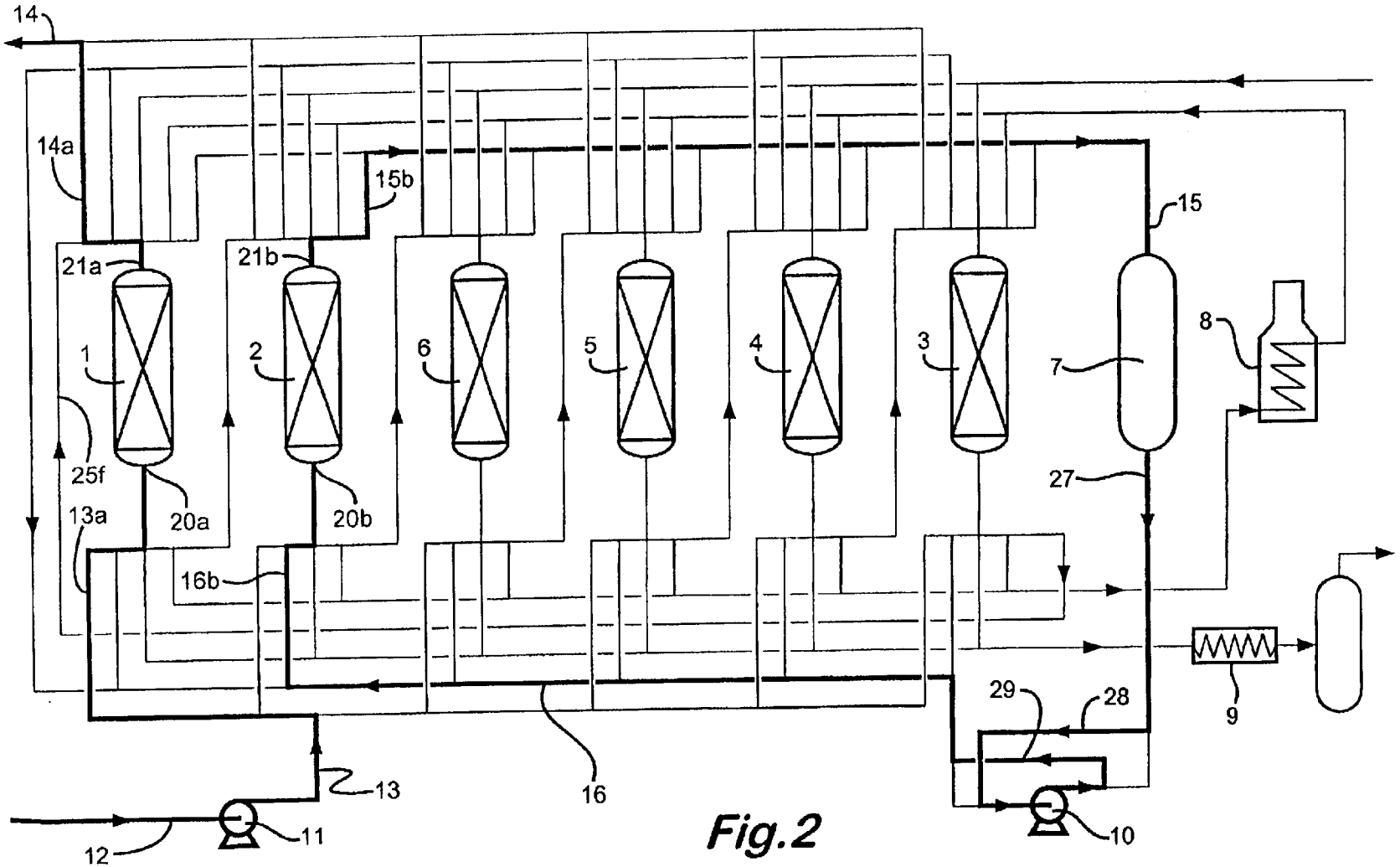

FIG. 2 shows the step (a) process of fill and adsorption for a 6 bed process in which adsorber (1) is adsorbing and adsorber (2) is being filled. This process happens before that shown in FIG. 1. Regeneration gas from the second adsorber (2) via lines (15*b*) and (15) enters drain tank (7) as liquid hydrocarbon feed drains from the drain tank into lines 27 and 28 from whence passes into a transfer pump (10) and then via line (29) (16), (16*b*) passes into the second adsorber (2) at port (20*b*). Liquid hydrocarbon feed comprising sulphur passes via feed pump (11) and lines (13) and (13*a*) into the inlet (20*a*) of first adsorber (1) wherein sulphur is adsorbed from the liquid hydrocarbon feed and liquid hydrocarbon feed of reduced sulphur content exits the outlet (21*a*) of the first adsorber via lines (14*a*) and thence (14) wherein it is recovered.

Figure 3:
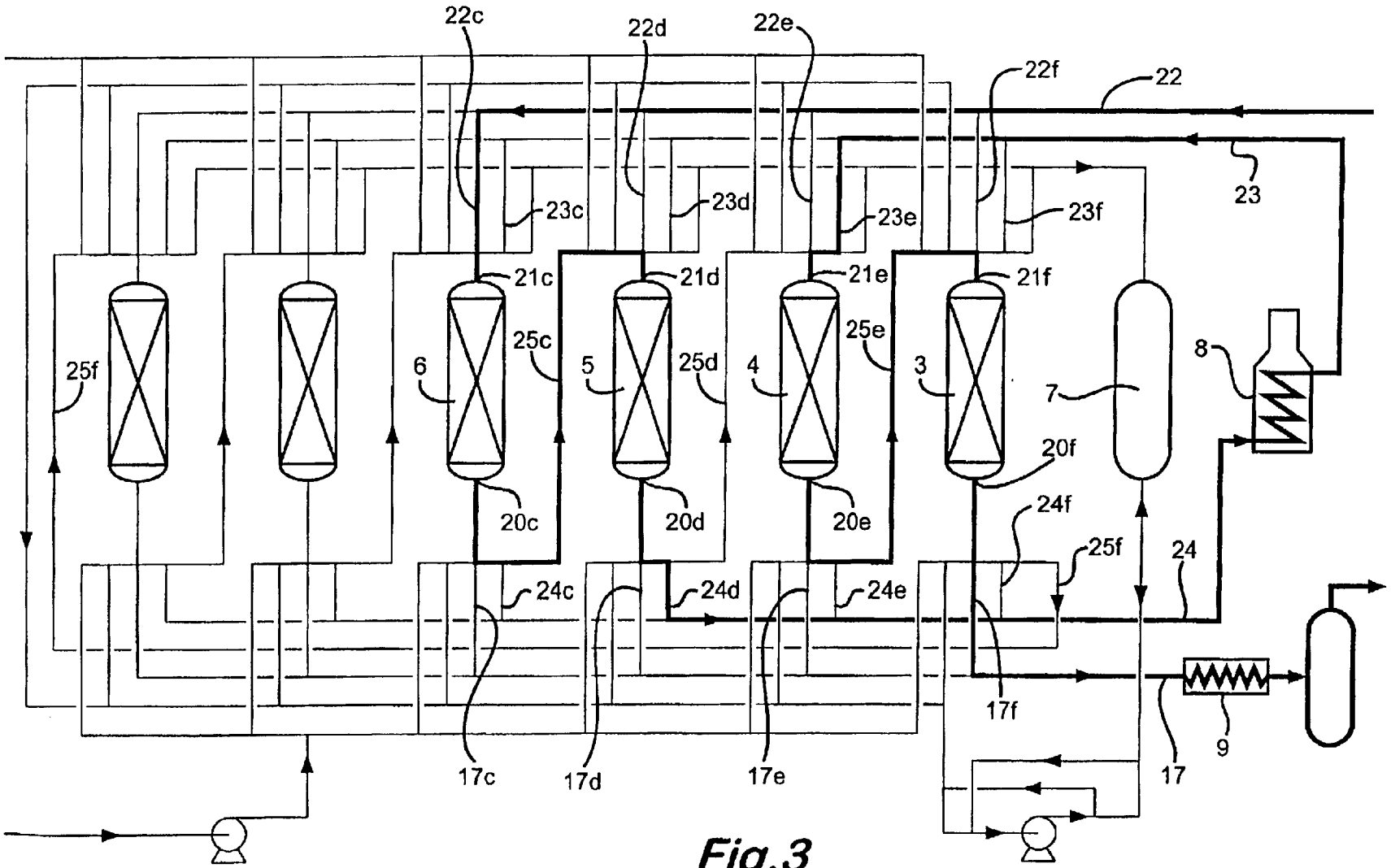

FIG. 3 shows a 4 stage regeneration for a 6 bed process. Cold regeneration gas via lines (22) and (22*c*) enters the inlet (21*c*) of the sixth adsorber (6) which is undergoing step (c)(ii) wherein said sixth adsorber is further cooled. The regeneration gas exits the outlet (20*c*) of the sixth adsorber via line (25*c*) and enters the inlet (21*d*) of the fifth adsorber (5) which is undergoing step (c)(i) wherein said fifth adsorber (5) is initially cooled. The regeneration gas exits the outlet (20*d*) of the fifth adsorber via line (24*d*) and passes via line (24) through heater (8) and exits the heater (8) via line (23) and (23*e*) to enter at inlet (21*e*) the fourth adsorber (4) which is undergoing step (b)(ii) wherein said fourth adsorber is further heated and further sulphur is desorbed from the adsorber into the regeneration gas stream. The regeneration gas exits said fourth adsorber (4) via port (20*e*) and line (25*e*) and enters the inlet (21*f*) of the third adsorber (3) which is undergoing step (b)(i) wherein said third adsorber is initially heated and sulphur is desorbed from the adsorber into the regeneration gas stream. The regeneration gas exits the outlet (20*f*) of said third adsorber via lines (17*f*) and (17) and passes through cooler (9) to exit.

Figure 4:
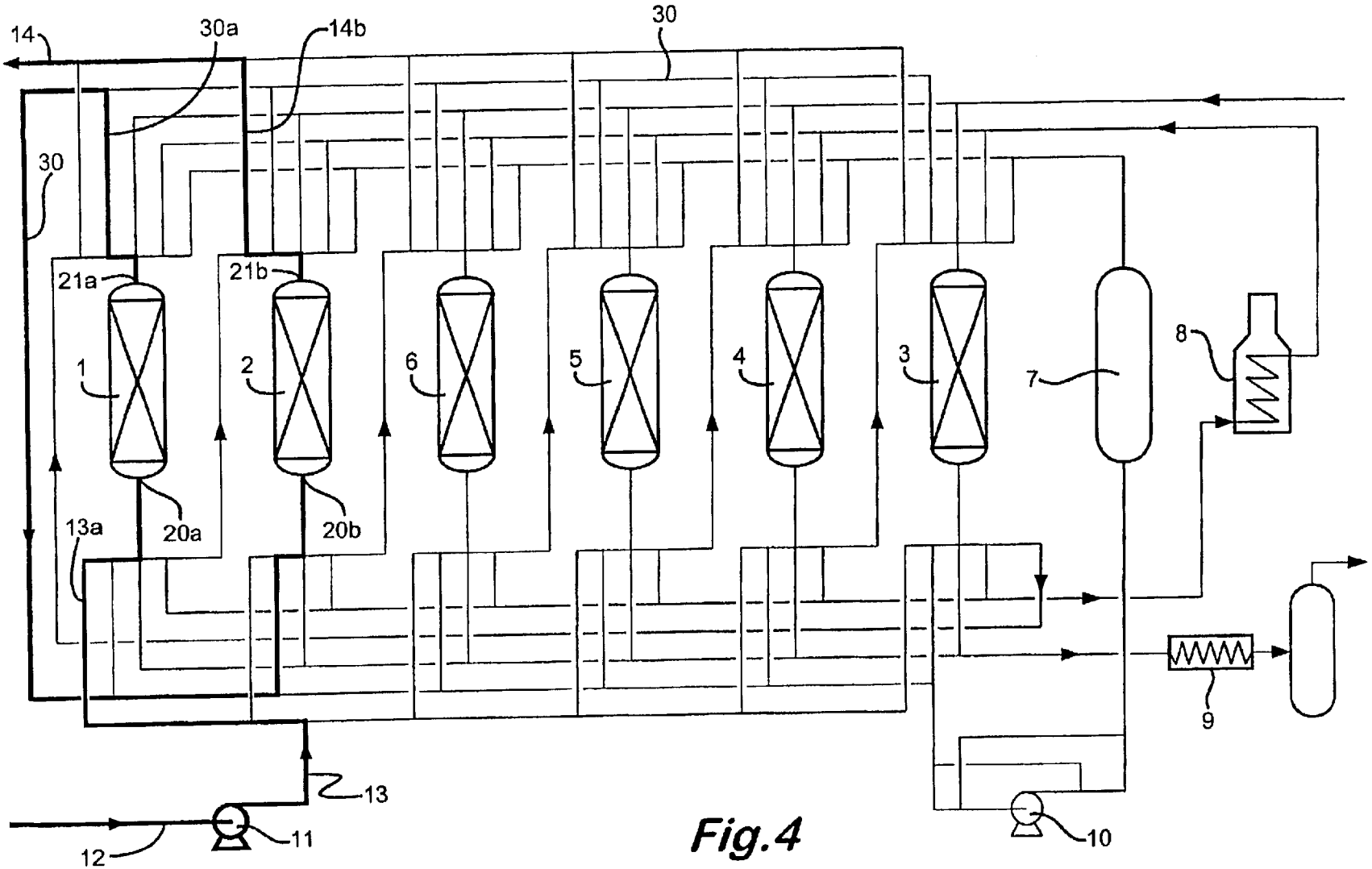

FIG. 4 shows the step (a) process of adsorption in series through two adsorbers for a 6-bed process in which both adsorber (1) and adsorber (2) are adsorbing while adsorbers 6–3 are being regenerated. Liquid hydrocarbon feed comprising sulphur enters the feed pump (11) via line (12). The liquid hydrocarbon feed passes via line (13) and (13*a*) into the inlet (20*a*) of the first adsorber (1) wherein sulphur is adsorbed from the liquid hydrocarbon feed and liquid hydrocarbon feed (of reduced sulphur content) exits the outlet (21*a*) of the first adsorber via line (30*a*) which leads via lines 30, 16 and 16*b* to the inlet (20*b*) of the second adsorber (2) wherein sulphur is further adsorbed from the liquid hydrocarbon feed (of reduced sulphur content). The purified liquid hydrocarbon feed (of further reduced sulphur content) exits the outlet (21*b*) of the second adsorber via line (14*b*) which leads to main purified product line (14) from which it is recovered.

EXAMPLES

The apparatus and process as described with respect to FIG. 1-3 was used with the adsorbers being of 3 m diameter and 8 m height. The fluid stream was a gasoline flow containing a sulphur content of 1400 ppm by weight. The gasoline was passed through the first and second adsorbers at 165 m 3/h at 30° C. at 1380 kPa. The gasoline was passed through each adsorber for 1.6 hrs. The purified gasoline contained less than 140 ppmS.

The total amount of silica adsorbent employed was 276 tonnes.

The regeneration gas used was a catalytic reformer off-gas stream and was introduced into the process at a pressure of 1380 kPa and a flow rate of 6600 m 3/h. The molar percentage regeneration gas composition is shown below:

| | |
|---|---|
| hydrogen | 86.00 |
| methane | 6.85 |
| ethane | 3.46 |
| propane | 2.18 |
| butanes | 0.98 |
| pentanes | 0.53 |

The flow of S containing gasoline was continued to any particular adsorber until the S content of the purified gasoline started to increase above 140 ppm.

The sulphur containing gasoline was passed through adsorbers (1) and (2). Regeneration gas was passed through the sixth adsorber (6). The regeneration gas entered the sixth adsorber at 30° C. during the process. The inlet of the sixth adsorber (6) was initially at 35° C. and the outlet was initially at 95° C. The inlet and the outlet temperature were lowered to 30° C. The gas leaving the adsorber was initially at a temperature of 95° C. but this fell to a temperature of 30° C.

The regeneration gas then passed through the fifth adsorber (5). The gas entered the fifth adsorber at an initial temperature of 95° C. which fell to 30° C. The inlet of the fifth adsorber (5) was initially at a temperature of 200° C. and the outlet was initially at 270° C. The inlet temperature was lowered to 35° C. and the outlet temperature lowered to 100° C. The gas leaving the fifth adsorber (5) was initially at 270° C. but decreased to 95° C.

The regeneration gas was then passed through the heater (8) leaving it at 280° C. and then to the fourth adsorber (4) entering at an initial temperature of 280° C. which fell to 200° C. The inlet of the fourth adsorber (4) was initially at 270° C. and the outlet was initially at 130° C. The inlet temperature was lowered to 200° C. at the outlet raised to 270° C. The gas leaving the fourth adsorber (4) was initially at 130° C. but increased to 270° C.

The regeneration gas finally flowed through the third adsorber (3) entering at a temperature 130° C. and leaving at 270° C. The inlet and the outlet of the third adsorber (3) were initially at 30° C. The inlet temperature was raised to 270° C. and the outlet temperature raised to 130° C. The gas leaving the third adsorber was initially at 30° C. but increased to 130° C.

After the adsorbers (6), (5), (4) and (3) had been subjected to the above regeneration stages the regeneration gas at 30° C. previously entering adsorber (6) is passed through adsorber (5) then to adsorber (4) then via a heater to adsorber (3) and then to adsorber (1) which had been previously adsorbing and has been drained of gasoline. The feed sulphur containing gasoline was passed through adsorbers (2) and the gasoline from tank (7) was passed through adsorber (6).

The process is continued by the passage of the regeneration gas and the sulphur containing gasoline through the appropriate adsorbers as dictated by the cyclic sequence i.e. for the gasoline through adsorber 2, 6, 5, 4, 3, 1.

The required energy input by the heater (8) was simulated using a computer program.

The above process was then resimulated with a different number of absorbers, with the same input and exit sulphur contaminant levels for purified gasoline and input and exit regeneration gas temperatures.

Table 1 shows the energy requirements of the heater for 4, 6 and 8 adsorber processes according to the invention and also for a 2-adsorber process.

TABLE 1

| No. of adsorbers | Regeneration gas flow ($m^3/h$) | Energy supplied to regeneration gas by the heater (MW) |
|---|---|---|
| 2 | 17000 | 7.3 |
| 4 | 10000 | 2.2 |
| 6 | 6600 | 1.1 |
| 8 | 5500 | 0.8 |

We claim:

1. A cyclic process to remove pollutant from fluid which comprises at least three concurrent steps:

(a) passing input fluid comprising pollutant through at least one adsorber to produce a polluted adsorber and a purified fluid stream of reduced pollutant content, which leaves the adsorber, stopping the flow into said adsorber to leave residual fluid therein, and separating said residual fluid from said adsorber to leave the polluted adsorber of reduced residual fluid content;

(b) heating a polluted adsorber with a heated regeneration gas to produce a hot adsorber of reduced pollutant content and cooler regeneration gas of increased pollutant content;

(c) contacting a heated adsorber of reduced pollutant content with a regeneration gas of a lower temperature than that of said adsorber to produce a cooler adsorber and a warmer regeneration gas, which gas is further heated to produce said heated regeneration gas which is passed to step (b);

said process comprising at least 3 adsorbers, at least one of which is being subjected to step (a), at least one different adsorber to step (b) and at least one further different adsorber being subjected to step (c), and after completion of one step the adsorber produced is subjected to the next step in the cyclic sequence (a)-(b)-(c)-(a).

2. A process according to claim 1 wherein step (a) comprises passing the separated residual fluid into a container.

3. A process according to claim 2 wherein step (a) comprises passing the prior separated residual fluid from said container to at least one adsorber prior to passing input fluid comprising pollutant through said adsorber.

4. A process according to claim 1 wherein at least 2 adsorbers are being subjected to step (a) at any one time.

5. A process according to claim 4 wherein step (b) comprises two concurrent steps (b)(i) heating a polluted adsorber with a regeneration gas of increased pollutant content to produce a heated polluted adsorber;

(b)(ii) further heating the heated polluted adsorber with a heated regeneration gas to produce a hot adsorber of reduced pollutant content and a regeneration gas of increased pollutant content and wherein the regeneration gas of increased pollutant content is passed to step (b)(i).

6. A process according to claim 5 wherein step (c) comprises two concurrent steps (c)(i) cooling a hot adsorber of reduced pollutant content from step (b) with regeneration gas of a lower temperature than that of the hot adsorber to produce a cooled adsorber, and heated regeneration gas;

(c)(ii) further cooling a cooled adsorber with a regeneration gas of a lower temperature than that of the cooled adsorber to produce a cooler adsorber and a warmer regeneration gas which is passed to a hot adsorber of reduced pollutant content undergoing step c(i) and wherein the heated regeneration gas produced in step c(i) is then heated further and passed to step (b).

7. A process according to claim 6 comprising six concurrent steps wherein a first and second adsorber are being subjected to step (a) a third adsorber is being subjected to step (b)(i), a fourth adsorber is being subjected to step (b)(ii) a fifth adsorber is being subjected to step (c)(i) and a sixth adsorber is being subjected step (c)(ii) and wherein said adsorbers are being subjected to their respective steps simultaneously.

8. A process according to claim 1 wherein the fluid is a liquid hydrocarbon stream.

9. A process according to claim 8 wherein the liquid hydrocarbon stream is a gasoline product resulting from the cracking of a high molecular weight hydrocarbon feed comprising 0.01–5% sulphur.

10. A process according to claim 1 wherein the adsorbers contain a porous oxide adsorbent.

11. A process according to claim 1 wherein the regeneration gas is hydrogen.

* * * * *